United States Patent [19]

Husch

[11] 3,976,671

[45] Aug. 24, 1976

[54] METHOD AND COMPOSITION FOR TREATING EDIBLE OILS AND INEDIBLE TALLOWS

[75] Inventor: Robert Leo Husch, Chicago, Ill.

[73] Assignee: Interstate Foods Corporation, Chicago, Ill.

[22] Filed: Apr. 7, 1975

[21] Appl. No.: 565,625

Related U.S. Application Data

[63] Continuation of Ser. No. 41,061, May 27, 1970, abandoned, which is a continuation-in-part of Ser. No. 811,614, March 28, 1969.

[52] U.S. Cl. ..... 260/428; 426/417; 426/271

[51] Int. Cl.[2] ..... C11B 3/00

[58] Field of Search ..... 260/428; 426/271, 417

[56] References Cited

UNITED STATES PATENTS 2,999,861 9/1961 Fleck et al. ..... 260/290

*Primary Examiner*—Ethel G. Love

*Attorney, Agent, or Firm*—Max Dressler; Joyce R. Niblack; Talivaldis Cepuritus

[57] ABSTRACT

A method for treating edible oils containing fatty acid to render the edible oils more suitable for preparation of foods which contemplates the treating of the edible oils with a molecular sieve to remove a sufficient amount of the fatty acids present. Molecular sieve is also used to upgrade the quality of inedible tallows and inedible oils by reducing their free-fatty-acid content and by reducing the darkness of color of the tallow.

1 Claim, No Drawings

METHOD AND COMPOSITION FOR TREATING EDIBLE OILS AND INEDIBLE TALLOWS

BACKGROUND OF THE INVENTION

This is a continuation of application Ser. No. 41,061, filed May 27, 1970, now abandoned, which in turn is a continuation-in-part of my co-pending application, Ser. No. 811,614, filed Mar. 28, 1969.

This invention relates to a method for treating edible oils, and also to methods for treating inedible tallows and oils. More particularly, the invention relates, in a first instance, to a method for treating edible oils to remove excessive amounts of fatty acids present in the edible oils to render the edible oils more suitable for preparation of foods. Similarly, the removal of excessive amounts of fatty acids present in inedible tallows and inedible oils results in an upgrading of the inedible tallow or oil and increases the market value of the inedible tallows and oils.

For a number of years there has been an increasing use of edible oils such as crude and refined vegetable and marine oils and animal fats in the preparation of foods. Examples of such foods are the french fried potatoes, fried chicken and fried fish, etc., which are normally fried in shortening. The wide preference for such fried foods has brought about a substantial number of drive-in and regular restaurants which prepare and serve foods fried in shortening.

As is well known, shortening is generally prepared from fats and oils. Fats and oils are esters of higher fatty acids and a trihydric alcohol, glycerol. Such esters are known as glycerides. However, glycerides in shortening, as well as those in fats and oils, are subject to deterioration through contact with water or by thermal degradation. For example, the glycerides may be hydrolyzed to yield glycerol and free fatty acids or their salts.

In the frying of foods, some foods such as potatoes absorb a substantial amount of the edible oil, such as shortening, in which the food is being fried, so that there is a continuous depletion of the edible oil and the addition of fresh make-up oil. Other foods such as fish do not absorb appreciable amounts of oil and, therefore, the same batch of oil is used repeatedly for a long period of time. In the frying of such relatively nonabsorbent foods, there is a tendency for free fatty acids to accumulate in the oil. Free fatty acids are extremely objectionable in foods and their presence in amounts exceeding about 1.2 or 1.3% by weight of the oil generally renders the oil unsuitable for use in frying foods.

From the above, it can be gathered that in the frying of a nonabsorbent food, such as fish, the edible oil is periodically observed for indications of degradation. When the fatty acids content of the oil exceeds the objectionable amount, it must be discarded. To my knowledge, there is nothing commercially available at the present time which can be used to extend the life of edible oil which contains an excessive amount of free fatty acids.

In connection with inedible tallows and inedible oils, the value of the tallow or oil increases as the free-fatty-acid (FFA) content is reduced. To achieve desirable tallows of lower fatty acid content, the present practices are to blend a tallow with relative higher fatty acid content with a tallow having a lower fatty acid content, or to use a caustic to lightly caustic-refine the tallow. If it is desired to lighten the color of the tallow product, it is the usual practice to bleach the tallow as a separate and later step after reduction of the fatty acid content in the mixture. These processes are relatively costly since, for example, the blending process uses a tallow that is already commercially acceptable.

It is accordingly an object of the present invention to provide a method for extending the life of edible oil which contains excessive amounts of free fatty acids.

It is another object of the invention to provide an economical method for treating edible oil.

It is further an object of the present invention to provide a relatively simple method for removing free-fatty-acids from edible oils, which is economical and quick to use.

It is still another object of this invention to provide a simple and economical method for removing free fatty acids from inedible tallows and inedible oils, and for reducing the color of such substances so as to commercially upgrade the value of such inedible tallows and oils.

And still another object of this invention is to provide an improved method for removing free-fatty-acids, with unexpected and dramatic efficiency, from edible oils that have already been used in a cooking operation, such as in a food-preparation installation or the like.

Further objects of the invention can be gathered from the following disclosure.

SUMMARY OF THE INVENTION

In accordance with the present invention, I provide a method for extending the life of edible oil used in the frying of foods by removing the free fatty acids therefrom. As used herein, the term "free fatty acids" is intended to cover free fatty acids and their common salts. The removal of the free fatty acids is accomplished by passing the edible oil through a bed containing a molecular sieve. Other treating materials for the edible oil, such as a bleaching agent or a physical filtering air material, can also be used with the invention.

The method of the invention will reduce the free fatty acids content of the edible oil to a very low level. In this manner, the method of the invention will extend the life of edible oil as well as make the foods fried in the oil better for human consumption because of the minimal free fatty acids content.

In the treatment of inedible tallows and/or oils, I either mix a molecular sieve with the tallow and then filter out the spent molecular sieve, or pass the tallow through a bed that contains a molecular sieve.

DESCRIPTION OF THE PREFERRED EMBODIMENT

As indicated above, the present invention contemplates the treating of edible oil (and also inedible tallows and oils) by passing it through a bed containing a molecular sieve. Examples of suitable molecular sieves are those made by the Linde Company and under the trade designation 10X and 13X.

The bed used in the method of the present invention may suitably be supported by a liquid permeable support, such as a filter cloth or paper, in a filtering apparatus, such as a grid, a funnel or a filter press.

The molecular sieve of the present invention may be used either alone or in combination with other treating materials for the edible oil (or for the inedible tallow or oil). Thus, a filter paper or cloth may be advantageously placed on top of the bed so that any breaded particles and other food matters in the edible oil may be filtered out and not contaminate the bed. Other materials which may be advantageously used in conjunction with the molecular sieve of the invention are various filtering aids. These aids include diatomaceous earth, asbestos filtering aids, and purified cellulose materials. Examples of the diatomaceous earth which may be used in the treatment of the invention include fuller's earth and a family of filtering aids sold by the Johns-Manville Products Corporation under the name Celite. If a diatomaceous earth is to be used in connection with the treatment of the present invention, the earth may be mixed with the molecular sieve so that the edible oil needs to be passed through only one bed of treating material. Alternatively, the molecular sieve and the diatomaceous earth may form separate beds disposed in a series relationship so that the edible oil can pass from one bed into the other.

I had originally found that molecular sieve is capable of removing about one-tenth its own weight in fatty acids from edible oil. Thus, I had proposed that if one hundred pounds of edible oil is to be treated, whose fatty acids content is to be reduced from 0.5% by weight to 0.05% by weight, about 0.45 pound of free fatty acids must be removed which would require the use of about 4.5 pounds of molecular sieve.

When only a few pounds or less of molecular sieve are needed and used, it would not be economical to attempt to remove the free fatty acids therein by regeneration so that the molecular sieve may be reused. However, the spent molecular sieve may be collected and stored until a sufficient quantity is gathered to justify regeneration.

The treatment of the present invention may also be used to reduce the free fatty acids content of crude edible oils and fats. Crude edible oil usually contains some fatty acids which must be removed. Presently the most common deacidification process for crude edible oils and fats is by alkali refining. Alkali refining involves adding moderately strong solutions of caustic soda or alkaline salts such as sodium carbonate. Such a treatment requires a chemical reaction followed by a separation process. Thus, deacidification by alkali refining is clearly time consuming and inconvenient as well as being expensive. In accordance with the present invention, such deacidification of crude oil may now be carried out in a continuous manner which is extremely convenient and economical to use. For example, if 10,000 pounds of crude edible oil per hour is to be treated to reduce the free fatty acids content therein from 0.5% to 0.05% by weight, about 45 pounds of fatty acids must be removed per hour which would require the use of about 450 pounds of molecular sieve. This may be accomplished in a continuous manner, for example, by providing at least two reactors disposed in parallel, each of which contains 2,000 pounds of molecular sieve. In practice, one of the two reactors may be used to treat the crude oil while the other reactor would be in the regeneration cycle. Such a system of two reactors can provide continuous treatment for crude edible oils and fats and requires switching between the reactors only once every few hours.

The method for determining the free fatty acids content of an edible oil is known to those skilled in this art. As a specific example, the Official Method Ca 5a-40 of the American Oil Chemists'Society may be used. This method is applicable to crude and refined vegetable and marine oils and animal fats.

In the treatment of inedible tallows or oils, I have discovered that using molecular sieve, either mixed with the inedible tallow or oil, before filtering out the used molecular sieve, or as a bed through which the inedible tallow or oil is passed, results in a more uniform product with respect to the color and free-fatty-acid (FFA) content of the final product. The amount of molecular sieve material (which includes both molecular sieve and a filter aid such as Celite 501) that I have used to achieve the desired result is preferably in the range of 0.1% to 0.15%, by weight of molecular sieve material to weight of material being treated. The molecular sieve material used consisted of a mixture of 25% molecular sieve and 75% Celite 501, the latter material being inert as far as fatty acid adsorption and effecting a color change is concerned.

As still another feature of this invention, I have now discovered that in treating edible oils, shortly after they have been used in a cooking operation in a food-preparing installation, with the said molecular sieve material (a mixture of molecular sieve and Celite 501), the amount of free-fatty-acid (FFA) actually removed from such used edible oils by such a treatment far exceeds the earlier predicted capability for free-fatty-acids removal by molecular sieve. Thus, while I had initially believed that molecular sieve (as a pure material without being mixed with a filter aid) would remove about one-tenth its own weight in free-fatty-acids from edible oil, I was surprised to find that in treating edible oils (shortly after they have already been used in a cooking operation corresponding to a day's cooking operation in a commercial drive-in restaurant) with molecular sieve material (the mixture above defined), the active element of molecular sieve operates to remove about 8 to 10 times its own weight of free-fatty-acids, and consequently the molecular sieve is about 80 to 100 times more effective than initially expected to be the case.

The invention will now be described in further detail with reference to specific examples.

EXAMPLE 1

A large commercial frying vessel containing about 42 pounds of shortening was used to fry 12.6 pounds of fish a day. Using fresh shortening at the beginning of the day, it was found that at the end of one day's fish frying, the free-fatty-acid content of the shortening had increased from about 0.05% by weight to about 0.13%. At the same time, the peroxide value of the shortening had risen from 0.5 to about 4.4. The peroxide value of the shortening is an indication of the rancidity of the shortening. At the end of the day of frying, the shortening was filtered through a bed containing 1.7 pounds of a filtering material which contains 15% of a molecular sieve 13X, 40% Micro Cell T-49 (made by Johns-Manville), 40% Clarolite S (made by Georgia Kaolin Company), and 5% Solka Floc (made by Gref Co). All percentages are by weight. After this treatment, the shortening was found to contain about 0.04% by weight of free-fatty-acids and its peroxide value has been reduced to 3.0.

The Micro Cell T-49 is a filter aid. The Clarolite S is also a filter aid and it is an asbestos material which facilitates the flow of the shortening through the filtering bed. The Solka Floc is a purified cellulose material which reduces dusting of the bed of filtering material.

EXAMPLE 2

The batch of 42 pounds in Example 1 was continually used to fry fish for a period of ten days. After each day's use, the shortening was treated as in Example 1. Fresh make-up shortening was added from time to time to maintain the batch of shortening at about 42 pounds. At the end of the 10 days' frying, a total of about 252 pounds of fish had been cooked in the shortening. At the beginning of the tenth day, the shortening contained about 0.065% free-fatty-acids. After the tenth day, the shortening contained about 0.23% free-fatty-acids. The shortening was then put through 1.7 pounds of the material described in Example 1 and the free-fatty-acids content was reduced to 0.07% by weight.

From this example, it can be seen that the shortening has a tendency to slightly deteriorate with prolonged use so that the increase in acids content during the tenth day is much greater than that for the first day.

EXAMPLE 3

Another fresh batch of 42 pounds of shortening was placed in a commercial frying pan and used to fry about 25 pounds of fish per day. At the end of each day, the shortening was filtered through a bed of fuller's earth. After three days' usage, with a total of 75 pounds of fish fried therein, and after the final filteration through fuller's earth, the acids content in the shortening was found to be 0.38% by weight.

By comparing the results of Examples 2 and 3, it can be seen that the treatment of the present invention is extremely effective in reducing the fatty acids content of shortening used in frying foods. In this manner, the useful life of the shortening employed in frying foods has been extended greatly and the fatty acids content of the foods fried in the shortening treated by the present process has also been greatly reduced. This results in a fried food which contains less fatty acids and so is more suitable for human consumption.

EXAMPLE 4

A 1500 gram sample of liquid inedible tallow at 250° F. had added to it 1.5 grams of a molecular sieve material, consisting of 25% molecular sieve, 75% Celite 501 mixture. The mixture was passed through a filter, taking samples at approximately 100 gram filtrate increments. The samples were checked for free-fatty-acid content. The free-fatty-acid content of the tallow prior to mixing with the molecular sieve material was 2.06%. The point at which samples were taken and the free-fatty-acid content of the samples were determined in the following sequence:

| Sample Weight In Sequence (grams) | Free-Fatty-Acid Content (%) |
|---|---|
| 100 | 1.83 |
| 100 | 1.77 |
| 100 | 1.63 |
| 100 | 1.44 |
| 100 | 1.35 |
| 100 | 1.38 |
| 100 | 1.35 |
| 100 | 1.42 |
| 200 | 1.35 |
| 200 | 1.53 |
| 200 | 1.79 |
| 100 | 1.91 |

EXAMPLE 5

Using 1½ grams of a 25% molecular sieve, 75% Celite 501 mixture as a bed on a Buchner funnel, 1500 grams of liquid inedible tallow, at 250° F. with original free-fatty-acid content of 0.97%, was passed through said bed in 100 gram increments. The free-fatty-acid content of the filtered increments was determined in the following sequence:

| Sample Weight In Sequence (grams) | Free-Fatty-Acid Content (%) |
|---|---|
| 100 | .54 |
| 100 | .44 |
| 100 | .43 |
| 100 | .42 |
| 100 | .44 |
| 100 | .45 |
| 100 | .42 |
| 100 | .41 |
| 100 | .44 |
| 100 | .48 |
| 100 | .56 |
| 100 | .59 |
| 100 | .71 |
| 100 | .88 |
| 100 | .97 |

The samples of inedible tallow with reduced fatty acid content were noted as having lighter color than the original batch. Examination of the results, reported hereinabove as Examples 4 and 5, show that when the molecular sieve material was mixed with the sample prior to filtering, each sample weight has a material reduction in free-fatty-acid content. When the original batch of tallow was passed through a bed of molecular sieve material used in proportion of 0.10 per cent by weight of tallow being processed, the ratio of reduction of free-fatty-acid in the samples compared to that of the original batch was more dramatic in the initial 80% of filtrate, but then the molecular sieve apparently became spent and the free-fatty-acid content of the last three samples rose successively until the last sample had the same free-fatty-acid content as the original batch. Use of a greater amount of molecular sieve material, in the order of at least 0.15 per cent by weight of tallow being processed would maintain the reduction of free-fatty-acid content of the entire batch.

EXAMPLE 6

A six ounce quantity of molecular sieve material, containing a mixture of 7 1/2% molecular sieve and 92 1/2% of Celite 501, was distributed evenly on the bottom of a mechanical filter.

Each of four fryers were filled with 42 lbs. of edible oil, and food was fried in each one for an 11 hour period. The foods cooked in the fryers were: pies in Fryer 1, potatoes in Fryers 2 and 3, fish in Fryer 4. The oil from each fryer was then passed through the filter with said molecular sieve material thereon.

The free-fatty-acid content of the oil from each fryer before and after filtering showed the following results, with fatty-acid content reported as a percent of the sample measured.

| | Fryer 1 | Fryer 2 | Fryer 3 | Fryer 4 |
|---|---|---|---|---|
| Before | 1.43% | 2.35 | 2.54 | 2.35 |
| After | 1.34 | 2.11 | 2.41 | 2.26 |
| | .09 | .24 | .13 | .09 |

Thus the total fatty-acids removed was:

-continued

.09% × 42 lbs. equals .0378
.24% × 42 lbs. equals .1008
.13% × 42 lbs. equals .0546
.09% × 42 lbs. equals .0378
Total .2310 lbs of free-fatty-acids (FFA)

Calculating the amount of molecular sieve in the six ounces of mixture, it will be seen that only 0.45 ounces of molecular sieve (0.075 × 6 oz.) operated to remove 3.69 ounces (0.231 lb. × 16 oz/lb.) of FFA. The molecular sieve thus removed about 8 times its own weight of FFA from the edible oil that had been used in a cooking operation.

EXAMPLE 7

A six ounce quantity of molecular sieve material, containing a mixture of 7 ½% molecular sieve and 92 ½% of Celite 501, was distributed evenly on the bottom of a mechanical filter.

Each of four fryers were filled with 42 lbs. of edible oil, and food was fried in each one for an 11 hour period, corresponding generally to a day's cooking operation at a food-preparing establishment such as a drive-in restaurant. The foods cooked in the fryers were: pies in Fryer 1, potatoes in Fryers 2 and 3, fish in Fryer 4. The oil from each fryer was then passed through the filter with said molecular sieve material on it as described above.

The free-fatty-acid content of the oil from each fryer before and after filtering showed the following results, with fatty-acid content reported as a per cent of the sample measured.

| | Fryer 1 | Fryer 2 | Fryer 3 | Fryer 4 |
|---|---|---|---|---|
| Before | .703% | 1.76 | .921 | 1.45 |
| After | .571 | 1.55 | .730 | 1.32 |
| | .132 | .21 | .191 | .13 |

Thus the total fatty-acids removed was:
.132% × 42 lbs. equals .055 lbs.
.21% × 42 lbs. equals .088 lbs.

-continued

.191% × 42 lbs. equals .080 lbs.
.13% × 42 lbs. equals .055 lbs.
Total 0.278 lbs. FFA Again, calculations show that only 0.45 ounces of molecular sieve operated to remove 4.4 oz. of FFA. The molecular sieve thus removed nearly 10 times its own weight of FFA from the edible oil that had been used in a cooking operation.

EXAMPLE 8

An attempt was made to determine ability of pure molecular sieve to remove free-fatty-acids from inedible oils.

1.0 gram of 100% molecular sieve, Linde 13X, was agitated with 1500 grams of inedible tallow for half an hour. Then this material was passed through a filter. The results are as follows:

| | |
|---|---|
| Original FFA content was | 2.12% |
| Final FFA content was | 1.16% |
| Reduction was | .96% |

Thus, calculations show that the one gram of molecular sieve removed 14.4 grams (0.96% × 1500 grams) of free-fatty-acids.

While the invention herein has been described in detail with reference to particular and preferred embodiments thereof, it will be understood that variations and modifications can be made within the spirit and scope of the invention as described hereinabove and as defined in the appended claims.

What is claimed is:

1. A method for upgrading a material selected from the group consisting of inedible tallows and oils containing free fatty acids, which comprises the step of intimately contacting said material and a type X molecular sieve material capable of removing said free fatty acids, said molecular sieve material being present in an amount of 0.1 to 0.15 per cent by weight of the material being processed.

* * * * *